United States Patent [19]

Berliner

[11] 4,330,066

[45] May 18, 1982

[54] RECEPTACLE WITH COLLAPSIBLE INTERNAL CONTAINER

[76] Inventor: Robert Berliner, 3843 Dixie Canyon St., Sherman Oaks, Calif. 91423

[21] Appl. No.: 208,976

[22] Filed: Nov. 21, 1980

[51] Int. Cl.[3] ..... B65D 25/16

[52] U.S. Cl. ..... 215/1 C; 220/404

[58] Field of Search ..... 220/404; 215/1 C, 1 R

[56] References Cited

U.S. PATENT DOCUMENTS

| | | | |
|---|---|---|---|
| 2,553,232 | 5/1951 | Beyer | 220/404 X |
| 3,443,735 | 5/1969 | Meijers | 220/404 X |
| 3,610,455 | 10/1971 | Greenhalgh | 220/404 X |

*Primary Examiner*—Donald F. Norton

*Attorney, Agent, or Firm*—Nilsson, Robbins, Dalgarn, Berliner, Carson & Wurst

[57] ABSTRACT

A receptacle in which a collapsible fluid-holding container is disposed within an outer container of substantially fixed shape. The mouths of the containers are connected and formed internally to admit air between the containers via apertures through the side of the outer container mouth, whereby the inner container collapses as fluid is dispensed, thereby minimizing the intrusion of air into contact with the fluid. A cap closes the mouths and side apertures to seal the contents of the receptacle.

26 Claims, 7 Drawing Figures

RECEPTACLE WITH COLLAPSIBLE INTERNAL CONTAINER

FIELD OF THE INVENTION

The field of art to which the invention pertains includes the field of closable containers, particularly bottles.

BACKGROUND AND SUMMARY OF THE INVENTION

In the use of bottled fluids, such as liquids or flowable powders, one often finds that only a portion of the contents of the bottle is used. For those fluids that deteriorate or are otherwise adversely affected by contact with air, the contents remaining in the bottle must soon be used or else discarded. For example, wine deteriorates rapidly when in contact with air. Other common liquids, such as milk, fruit juices and the like are subject to deterioration once air is introduced into the container. Carbonated beverages are particularly subject to deterioration upon exposure to air; in this case, the beverage goes flat, not because of reaction with the air, but simply because of the escape of carbonation into the air space above the beverage. Exposure to air can be particularly severe with certain forms of medication in which the active ingredient is oxidized to ineffective, or perhaps harmful, form. Other materials, such as paint, form a hardening polymer upon exposure to air. The flow of fine powders can be hindered by absorption of moisture from air.

A variety of methods are available to overcome some of the foregoing deficiencies. For example, refrigeration can slow down the rate of oxidation and/or preservatives can be added. One can transfer the contents of an open container to a smaller container or can purchase only fluids that come in small containers. it will be appreciated that all of the foregoing methods have drawbacks in terms of convenience, consumption of time and expense. Any method or device for overcoming the foregoing problems must be relatively inexpensive and convenient, not only to use, but in initial incorporation during manufacture and/or bottling.

The present invention provides a device which permits the storage of the partial contents of a container without the foregoing drawbacks. A receptacle is provided in which a collapsible fluid-holding container is disposed witin an outer container of substantially fixed shape. The mouths of the containers are connected and formed internally to admit air between the containers via apertures through the side of the outer container mouth. As fluid is dispensed, the inner container collapses about the fluid that remains, minimizing the intrusion of air into contact with the fluid and isolating the fluid from air that enters the outer container. The inner and outer containers can be sealed by a cap which is fitted to close both the mouths and the side apertures.

More specifically, a receptacle is provided comprising an outer container of substantially fixed shape formed with a mouth defining an opening into the outer container, and an inner container for holding a fluid disposed within the outer container. The inner container is formed with a mouth, at least a portion of which is disposed within the mouth of the outer container. At least a major portion of the inner container is collapsible and means are provided for admitting air between the inner and outer containers, whereby to permit collapse of the inner container when fluid is poured therefrom. Means are provided for closing the mouth of the inner container, which can also serve to close off the means for admitting air between the inner and outer containers.

In a specific embodiment, the mouths are coaxial and both are of substantially fixed, generally cylindrical shape. The mouth of the outer container is recessed with an inner annular shoulder. The mouth of the inner container (which can be referred to as a mouthpiece) is formed with an outer annular continuous protruding rim formed to abut the outer container mouth shoulder. The inner container mouth is also formed with at least one flange extending outwardly from a portion only of its outer surface spaced downwardly from the rim and fitting into a recess formed on the inner surface of the outer container mouth. By such means, the inner container mouth can be snap-locked into the outer container mouth. In a specific embodiment, one or more flaps are disposed within the mouth of the inner container to impede back-flow of air. Means can also be provided, such as adhesive, for securing the inner container to the inside of the outer container at a region distal from the mouths, e.g., at the bottom of the container.

DETAILED DESCRIPTION

As required, details of illustrated embodiments of the invention are disclosed. However, it is to be understood that these embodiments merely exemplify the invention which may take forms different from the specific embodiments. Therefore, specific structural and functional details are not necessarily to be interpreted as limiting, but as a basis of the claims. In this regard, the illustrative embodiments herein comprise bottles for holding fluids that are in liquid form, but the concepts are readily applicable to other containers, for example, jugs and paint cans, and to other fluids, such as flowable powders, e.g. sugar, medicaments, cosmetic powders of various types, and the like..

Figure 1:
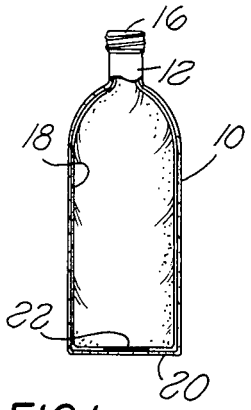
FIG. 1 is an elevational, partially cut-away view of a receptacle in accordance with the present invention, in which a flexible bag is disposed within a bottle of substantially fixed shape.
Figure 2:
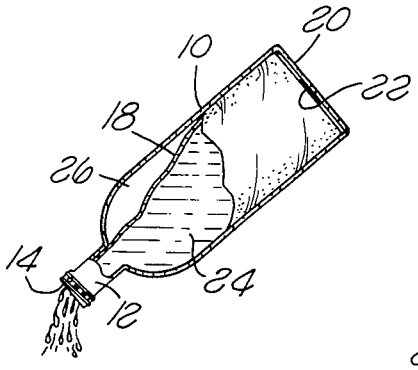
FIG. 2 is a view, partially cut-away, showing the pouring of fluid from the receptacle of FIG. 1 with consequent collapse of the flexible bag about the fluid.
Figure 3:
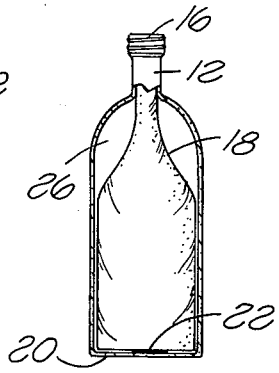
FIG. 3 is an elevational, partially cut-away view of the receptacle after its contents have been partially poured out.

Referring to FIGS. 1–3, the receptacle includes a bottle 10 having a substantially fixed shape formed, in this case, with a neck 12 and a mouth 14 extending upwardly from the bottle and closed, in FIGS. 1 and 3, with a cap 16. Internally, the bottle 10 contains a collapsible container, including a flexible bag 18 which completely fills the inside of the bottle 10. The bottom of the bag 18 can be secured to the bottom wall 20 of the bottle 10 by means of a layer of adhesive 22.

As shown by FIG. 2, when the cap 16 is removed, fluid 24 contained within the bag 18 can be dispensed via the mouth 14. By an arrangement to be described hereinafter, as the fluid 24 leaves the flexible bag 18, air 26 enters between the bag 18 and the surface of the bottle 10, collapsing the bag about the fluid, so that when the bottle is placed upward again, as shown in FIG. 3, the bag 18 will assume the shape of the fluid, isolating the fluid from the air 26. As will become more evident from the description hereinafter, by replacing the cap 16, the air 26 is sealed within the space defined by the outer surface of the bag 18 and inner surface of the bottle 10. It will be appreciated that outward expansion of the bag 18 will be resisted by increasing pressure from resulting compression of the air 26. Accordingly, if the fluid 24 is carbonated, loss of carbonation will be resisted.

Figure 4:
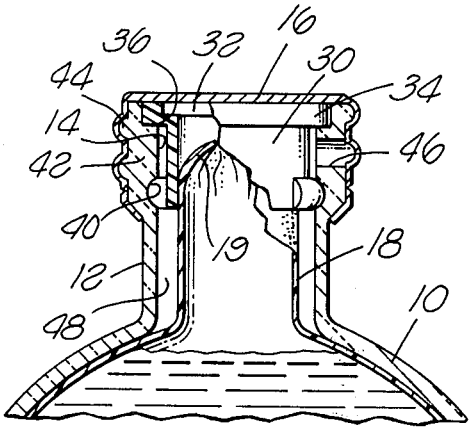
FIG. 4 is a cross-sectional view of the top, neck, mouth and cap portion of the outer container of the receptacle and a partially cut-away view of the bag, neck and mouth portion of the inner container.
Figure 5:
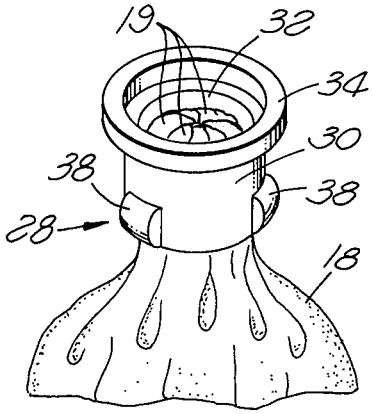
FIG. 5 is a perspective view of the top portion of the bag, neck and mouth of the flexible, inner container.

Referring to FIGS. 4 and 5, the inner container, indicated at 28, comprises the flexible bag 18 and a relatively rigid mouthpiece 30. The mouthpiece is axially disposed within the mouth 14 of the bottle. In this embodiment, the neck of the bag 18 is secured, such as by heat sealing or adhesive to the inner surface of the mouthpiece 30, leaving a plurality of flaps within the open mouth 32 of flaps 19 converging to form, in effect, a flap-type valve constriction to inhibit the flow of air back into the bag 18.

The mouthpiece 30 is formed with an outer annular continuous protruding rim 34, which abuts an inner annular shoulder 36 formed adjacent to the opened bottle mouth 14. A plurality of flanges 38, in this case 3 (one is hidden from the view of FIG. 5), extend outwardly from the lower outer surface of the mouthpiece 30 and are formed to snap-lock into an annular recess 40 formed on the inner surface of the bottle mouth 14.

Figure 6:
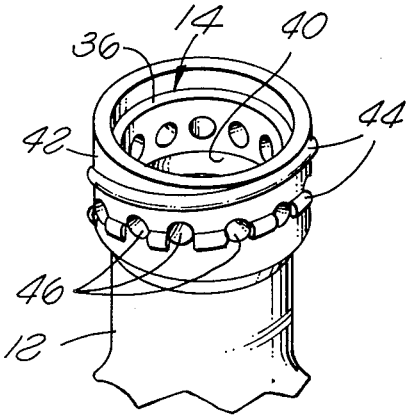
FIG. 6 is a perspective view of the neck and mouth portion of the outer container.

Referring additionally to FIG. 6, the recess 40 is continuous so that no particular orientation is required when the mouthpiece 30 is inserted into the bottle mouth 14. The bottle mouth 14 is defined by a thickened wall 42 as an extension of the bottle neck 12 and contains the usual threaded convolutions 44 by which the screw cap 16 can be screwed onto and off the bottle mouth 14. A plurality of apertures 46 are formed through the thread-forming convolutions 44, to provide a means for introducing air into the space 48 (FIG. 4) between the collapsible bag 18 and inner surface of the bottle 10. In this regard, the inner container mouthpiece flanges 38, in conjunction with the annular rim 34, serve to rigidly hold the mouthpiece 30 in snap-lock position within the bottle mouth 14 and also serve to space the outer surface of the mouth piece 30 from the inner surface of the bottle mouth 14, as well as serving to define channels through which air can be admitted from the apertures 46 to a region of the space 48 adjacent a collapsible portion of the bag 18.

The neck of the bag 18 may be formed without flaps 19, i.e., constructed to terminate flush against the inner wall of the mouthpiece. The usefulness of flaps to inhibit the back-flow of air into the bag 18 will depend on the flow rate of air through the bottle wall apertures 46 as compared to the flow rate of fluid out through the bag mouthpiece 30. Accordingly, the use of flaps 19 may be optional if the number and size of apertures 46, diameter of the open mouth 32 of the mouthpiece 30 and viscosity of the fluid contained in the bag 18 are such that air flow is predominantly into the space between the bag 18 and bottle 10.

As illustrated, it will be seen that the outer surface of the inner container mouthpiece 30 can be flush with the outer surface of the bottle mouth 14. Furthermore, as a result of seating of the annular rim 34 of the mouthpiece 30 against the annular shoulder 36 of the bottle mouth 14, the outer surface of the mouthpiece 30 is coterminus with the mouth of the bottle. Therefore, when fluid is poured from the bag 18, it will not fall back into the space between the bottle 10 and bag 18. Accordingly, a clean aesthetic appearance of the receptacle will be maintained.

It is possible to place the apertures 46 in a location other than through a side wall, and still collapse the bag about fluid remaining in the receptacle. However, one would not obtain the benefit of being able to seal those apertures by use of a simple cap.

Figure 7:
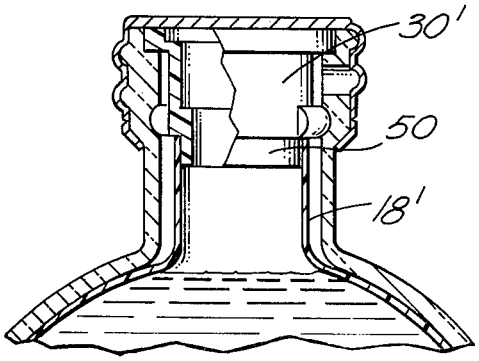
FIG. 7 is a cross-sectional view of the top, neck, mouth and cap portion of the outer container and a partially cut-away view of the top, neck and mouth portion of the inner container, of a receptacle in accordance with another embodiment of the invention.

Referring now to FIG. 7, an alternative embodiment is disclosed in which the components are identical in all respects to the components described with respect to FIGS. 4–6, except that the inner container mouthpiece 30' is formed with a downwardly dependent tubular member 50, slightly smaller in diameter than the diameter of the mouthpiece 30. In this case, the neck of the flexible bag 18' is formed to slip over the tubular member 50 and is secured to the outer surface of the tubular member 50 rather than to the inner surface of the mouthpiece. In this embodiment, no flap-valve type impediment is provided. In all other respects, the embodiment of FIG. 7 is the same and operates in the same manner as the embodiment of FIGS. 4–6.

The mouthpiece 30 or 30' and the bottle mouth 14 are each generally cylindrically formed, the terms "generally cylindrical" being meant to include not only straight tubular members but members in which there is a small degree of taper; in fact, such could facilitate snap-lock of the mouth piece.

The bag can be formed of any suitable collapsible material, such as polyethylene, flexible polypropylene, or the like, or it can be formed of a rubbery material that in its relaxed form is much smaller than the volume of the bottle 10. If a rubbery material is used, it will contract around the fluid remaining in the bottle rather than simply collapsing about the fluid.

In assembling the device, one need merely to fold the bag so that it and the mouthpiece 30 can be conveniently slipped within the neck of the bottle 10 and pushed down until the flanges 38 snap into the annular recess 40. The bottle can then be placed under a filling machine where the fluid product is dispensed readily, through the flaps 19 if present, into the bag 18, filling it out to the inner coutours of the bottle 10. Prior to insertion of the bag, one can apply a small amount of adhesive to the bottom portion of the bag so that when it is filled out, the bottom of the bag will be adhesively secured, as at 21 (FIG. 1) to the bottom 20 of the bottle 10. In this regard, one can use any appropriate slow curing anaerobic adhesive, as is well known in the art.

I claim:

1. A collapsible container for insertion into a container having a substantially fixed shape, said collapsible container comprising:

a flexible bag;

a mouthpiece of substantially fixed shaped defining the only opening into said flexible bag;

said mouthpiece being formed with an outer annular continuous protruding rim along a top edge thereof; and at least one flange extending outwardly from a lower portion of the outer surface of said mouthpiece and extending outwardly from said inner container mouth opening a distance greater than the outward extent of adjacent collapsible portions of said collapsible container.

2. The collapsible container of claim 1 in which said mouthpiece is generally cylindrical.

3. The collapsible container of claim 1 or 2, including at least one flap within said mouthpiece to impede back-flow of air into said bag.

4. A receptacle, comprising:

an outer container of substantially fixed shape formed with a mouth defining an opening into said outer container;

an inner container for holding a fluid, disposed within said outer container and formed with a mouth of substantially fixed shape defining an opening into said inner container, at least a portion of the mouth of said inner container being disposed within the mouth of said outer container, at least a major portion of said inner container being collapsible;

the mouth of said outer container comprising a wall extending outwardly of said container, the outer surface of the mouth of said inner container being spaced from the inner surface of said wall from at least a region adjacent the collapsible portion of said inner container;

at least one aperture through said wall for admitting air between said inner and outer containers whereby to permit collapse of said inner container when fluid is poured therefrom;

a cap fitted to close the mouth of said outer container and to overlie and close said aperture and the mouth of said inner container.

5. The receptacle of claim 4 in which the exterior surface of said mouth wall is threaded, said cap being formed to screw fit onto the mouth of said outer container.

6. The receptacle of claim 4 or 5 in which the outer surface of the mouth of said inner container is substantially coterminus with an inner surface of the mouth of said outer container, whereby to prevent fluid flowing from said inner container from entering between said containers.

7. The receptacle of claim 6 in which said mouths are coaxial, the mouth of said inner container being substantially cylindrical and including at least one flange extending outwardly from a portion only of the outer surface thereof spaced from the opening thereof, the inner surface of the mouth of said outer container being formed with a recess, for receiving said flange, spaced from the opening of said outer container mouth.

8. The receptacle of claim 4 or 5 including at least one flap within the mouth of said inner container to impede back-flow of air into said iner container.

9. A receptacle, comprising:

an outer container of substantially fixed shape formed with a mouth defining an opening into said outer container;

an inner container for holding a fluid, disposed within said outer container and formed with a mouth defining a opening into said inner container, at least a portion of the mouth of said inner container being disposed within the mouth of said outer container, at least a major portion of said inner container being collapsible;

means for admitting air between said inner and outer containers, whereby to permit collapse of said inner container when fluid is poured therefrom;

means for closing the mouth of said inner container; and means for securing said inner container to the inside of said outer container at a region distal from said mouths.

10. A receptacle, comprising:

an outer container of substantially fixed shape formed with a mouth defining an opening into said outer container;

an inner container for holding a fluid, disposed within said outer container and formed with a substantially cylindrical mouth that is coaxial with the mouth of said outer container, defining an opening into said inner container, at least a portion of the mouth of said inner container being disposed within the mouth of said outer container, at least a major portion of said inner container being collapsible, said inner container mouth including at least one flange spaced downwardly from the opening thereof and extending outwardly a distance greater than the outward extent of adjacent collapsible portions of said inner container;

means for admitting air between said inner and outer containers whereby to permit collapse of said inner container when fluid is poured therefrom; and means for closing the mouth of said inner container.

11. A receptacle comprising:

an outer container of substantially fixed shape formed with a mouth comprising a generally cylindrically shpaed wall extending outwardly of said outer container and defining an opening into said outer container;

an inner container for holding a fluid, disposed within said outer container, formed with a generally cylindrically shaped mouth having a substantially fixed shape defining an opening into said inner container and disposed within the mouth of said outer container, at least a major portion of said inner container being collapsible;

means for defining a space between the outer surface of the mouth of said inner container and the inner surface of said wall from at least a region adjacent a collapsibe portion of said inner container;

said wall defining at least one aperture therethrough for admitting air into said space whereby to permit collapse of said inner container when fluid is poured therefrom; and a cap fitted to close the mouth of said outer container and to overlie and close said aperture and the mouth of said inner container.

12. The receptacle of claim 11 in which the outer surface of the mouth of said container is coterminus with an inner surface of the mouth of said outer container whereby to prevent liquid flowing from said inner container from entering between said containers.

13. The receptacle of claim 11 or 12 in which the exterior surface of said mouth wall is threaded, said cap being formed to screw fit onto the mouth of said outer container.

14. The receptacle of claim 12 in which said mouths are coaxial, the mouth of said outer container being recessed with an inner annular shoulder, and the mouth of said inner container being formed with an outer annular continuous protruding rim for abutting said shoulder.

15. The receptacle of claim 11, 12 or 14 in which said space defining means comprises at least one flange extending outwardly from a portion only of the outer surface of the mouth of said inner container spaced from the opening thereof, for abutting the inner surface of said wall.

16. The receptacle of claim 15 in which the inner surface of said wall is formed with a recess, for receiving said flange, spaced from the opening of said outer container mouth.

17. The receptacle of claim 11, 12 or 14 including at least one flap within the mouth of said inner container to impede back-flow of air into inner container.

18. The receptacle of claim 11, 12 or 14 including means for securing said inner container to the inside of said outer container at a region distal from said mouth.

19. A receptacle comprising:

a bottle having a substantially fixed shape formed with a mouth defining an opening thereinto;

a collapsible bag for holding a fluid, disposed in said bottle and formed with a mouthpiece having a substantially fixed shape defining an opening into said bag and disposed within the mouth of said bottle;

means for defining a space between the outer surface of the mouthpiece of said bag and the inner surface of the mouth of said bottle from at least a region adjacent a collapsible portion of said bag;

the mouth of said bottle being formed with at least one aperture through a side thereof for admitting air into said space whereby to permit collapse of said bag when fluid is poured therefrom; and a cap fitted to close the mouth of said bottle and to overlie and close said aperture and the mouthpiece of said bag.

20. The receptacle of claim 19 in which the outer surface of the mouthpiece of said bag is coterminus with an inner surface of the mouth of said bottle whereby to prevent fluid flowing from said bag from entering between said bag and bottle.

21. The receptacle of claim 19 or 20 in which the exterior surface of the bottle mouth is threaded, said cap being formed to screw fit thereon.

22. The receptacle of claim 20 in which the mouth of said bottle and the mouthpiece of said bag are coaxial, the mouthpiece of said bottle being recessed with an inner annular shoulder, and the mouthpiece of said bag being formed with an outer annular continuous protruding rim for abutting said shoulder.

23. The receptacle of claim 19, 20 or 22 in which said space defining means comprises at least one flange extending outwardly from a portion only of the outer surface of the mouth of said bag spaced from the opening thereof, for abutting the inner surface of said bottle mouth.

24. The receptacle of claim 23 in which the inner surface of said bottle mouth is formed with a recess, for receiving said flange spaced from the opening of said bottle mouth.

25. The receptacle of claim 19, 20 or 22 including at least one flap within said mouthpiece to impede back-flow of air into said bag.

26. The receptacle of claim 19, 20 or 22 including means for securing said bag to the inside of said bottle at a region distal from said mouth and mouthpiece.

* * * * *